US006831986B2

(12) United States Patent
Kates

(10) Patent No.: US 6,831,986 B2
(45) Date of Patent: Dec. 14, 2004

(54) FEEDBACK CANCELLATION IN A HEARING AID WITH REDUCED SENSITIVITY TO LOW-FREQUENCY TONAL INPUTS

(75) Inventor: James M. Kates, Niwot, CO (US)

(73) Assignee: GN ReSound A/S, Taastrup (DE)

( * ) Notice: Subject to any disclaimer, the term of this patent is extended or adjusted under 35 U.S.C. 154(b) by 267 days.

(21) Appl. No.: 10/224,519

(22) Filed: Aug. 20, 2002

(65) Prior Publication Data

US 2003/0053647 A1 Mar. 20, 2003

Related U.S. Application Data

(63) Continuation-in-part of application No. 09/745,497, filed on Dec. 21, 2000, now Pat. No. 6,498,858.

(51) Int. Cl.[7] ..... H04R 25/00

(52) U.S. Cl. ..... 381/312; 381/318

(58) Field of Search ..... 381/312, 318, 381/320, 321, 71.11, 71.12, 83, 93, 94.1, 94.2

(56) References Cited

U.S. PATENT DOCUMENTS

| | | | | |
|---|---|---|---|---|
| 4,689,818 A | | 8/1987 | Ammitzboll | |
| 4,731,850 A | | 3/1988 | Levitt et al. | |
| 4,939,685 A | | 7/1990 | Feintuch | |
| 5,016,280 A | | 5/1991 | Engebretson et al. | |
| 5,019,952 A | | 5/1991 | Smolenski et al. | |
| 5,091,952 A | * | 2/1992 | Williamson et al. | 381/318 |
| 5,189,664 A | | 2/1993 | Cheng | |
| 5,259,033 A | * | 11/1993 | Goodings et al. | 381/318 |

(List continued on next page.)

FOREIGN PATENT DOCUMENTS

DE 4010372 10/1991

OTHER PUBLICATIONS

Bisgaard, Nikolai, "Digital Feedback Suppression—Clinical Experiences with Profoundly Hearing Impaired," *Recent Developments in Hearing Instrument Technology: 15th Danavox Symposium*, J. Beilin and G.R. Jensen, Eds., Kolding, Denmark, pp. 370–384, 1993.

(List continued on next page.)

*Primary Examiner*—Huyen Le
(74) *Attorney, Agent, or Firm*—Michael J. Bolan; Bingham McCutchen LLP

(57) ABSTRACT

A feedback cancellation system with reduced sensitivity to low-frequency tonal inputs is provided. Such a system can be used, for example, in a hearing aid to prevent cancellation of the desired tonal inputs to the hearing aid, thus improving the gain at high frequencies of the hearing aid while simultaneously preserving the desired tonal inputs at low frequencies. The feedback cancellation system comprises a first adaptive filter block for adaptively filtering an error signal to remove the low-frequency tonal components from the error signal. The first adaptive filter block is constrained so that only low-frequency tones in the error signal are cancelled, thus enabling the feedback cancellation system to still cancel "whistling" at high frequencies due to the temporary instability of the hearing aid. A second adaptive filter block adaptively filters a feedback path signal to produce an adaptively filtered feedback path signal. The first and second adaptive filter blocks are identical and filter coefficients of the first adaptive filter block are copied to those of the second adaptive filter block. Using an LMS adaptation algorithm, filter coefficients of an adaptive filer of the feedback cancellation system are controlled by the adaptively filtered error signal and the adaptively filtered feedback path signal respectively inputted from the first and second adaptive filter blocks. The adaptive filter then produces an adaptively filtered modeled feedback signal to be subtracted from an electrical audio signal input for updating the error signal of the hearing aid. The hearing aid processes the updated error signal with a digital signal processor to generate an audio output.

45 Claims, 7 Drawing Sheets

U.S. PATENT DOCUMENTS

| | | | | | |
|---|---|---|---|---|---|
| 5,402,496 | A | | 3/1995 | Soli et al. | |
| 5,406,634 | A | | 4/1995 | Anderson et al. | |
| 5,561,598 | A | | 10/1996 | Nowak et al. | |
| 5,940,519 | A | | 8/1999 | Kuo | |
| 6,072,884 | A | * | 6/2000 | Kates | 381/318 |
| 6,498,858 | B2 | * | 12/2002 | Kates | 381/318 |

OTHER PUBLICATIONS

Bustamante, Diane K., Thomas L. Worrall, and Malcolm J. Williamson, "Measurement and Adaptive Suppression of Acoustic Feedback in Hearing Aids," *ICASSP '89 Proceedings*, Glasgow, pp. 2017–1989.

Dyrlund, Ole and Nikolai Bisgaard, "Acoustic Feedback Margin Improvements in Hearing Instruments Using a Prototype DFS (Digital Feedback Suppression) System," *Scand Audiol*, vol. 20, pp. 49–53, 1991.

Drylund, Ole, Lise B. Henningsen, Nikolai Bisgaard, and Janne H. Jensen, "Digital Feedback Suppression: Characterization of Feedback–Margin Improvements in a DFS Hearing Instrument," *Scand. Audiol.* vol. 23, pp. 135–138, 1994.

Egolf, David P., "Review of the Acoustic Feeback Literature from a Control Systems Point of View," *The Vanderbilt Hearing–Aid Report*, Studebaker and Bess, Eds. Upper Darby, PA: Monographs in Contemporary Audiology, pp. 94–103, 1982.

Engebretson, A. Maynard, Michael P. O'Connell and Fengmin Gong, An Adaptive Feedback Equalization Algorithm for the CID Digital Hearing Aid;: *Annual International Conference for the IEEE Engineering in Medicine and Biology Society*, Part 5, vol. 12, No. 5, Philadelphia, PA pp. 2286–2287, 1990.

Engebretson, A. Maynard, and Marilyn French–St. George, "Properties of an Adaptive Feedback Equalization Algorithm," *Journal of Rehabilitation Research and Development*, vol. 30, No. 1, pp. 8–16, 1993.

French–St. George, Marilyn Douglas J. Wood, and A. Maynard Engebretson, "Behaviorial Assessment of Adaptive Feedback Equalization in a Digital Hearing Aid," *Journal of Rehabilitation Research and Development*, vol. 30, No. 1, pp. 17–25, 1993.

Gerzon, Michael, et al., "Optimal Noise Shaping and Dither of Digital Signals," *87th Convention 1989 Oct. 18–21, New York*, Audio Engineering Society Preprint.

GN Danavox A/S, "Hearing Aid Compensating for Acoustic Feedback," International Application No. PCT/DK93/00106, filed Mar. 23, 1993.

Greenberg, Julie E. and Patrick M. Zurek, "Evaluation of an Adaptive Beamforming Method for Hearing Aids," *The Journal of the Acoustical Society of America*vol. 91, No. 3, 1992, 1662–1676.

Ho, K.C., and Y.T. Chan, "Bias Removal in Equation–Error Adaptive IIR Filters," *IEEE Transactions on Signal Processing*, vol. 43, No. 1, pp. 51–62, Jan. 1995.

Kates, James M., "A Computer Simulating of Hearing Aid Response and the Effects of Ear Canal Size," *J. Acoust. Soc. Am.*, vol. 83 (5), pp. 1952–1963, May 1988.

Kates, James M., "Feedback Cancellation in Hearing Aids; Results from a Computer Simulation," *IEEE Transactions on Signal Processing*, vol. 39, No. 3, pp. 553–562, Mar. 1991.

Lybarger, Samuel F., "Acoustic Feedback Control," *The Vanderbilt Hearing–Aid Report*, Studebaker and Bess, Eds. Upper Darby, PA: Monographs in Contemporary Audiology, pp. 87–90, 1982.

Makhoul, John, "Linear Prediction: A Tutorial Review," *Proceedings of the IEEE*, Vo. 63, No. 4, pp. 561–580, Apr. 1975.

Maxwell, Joseph A., and Patrick M. Zurek, "Reducing Acoustic Feedback in Hearing Aids,:" *IEEE Transactions on Speechand Audio Processing*, vol. 3, No. 4, 1995, 304–313.

Minnesota Mining and Manufacturing Company, European Patent Application for "Auditory Prosthesis with User–Controlled Feedback," Application No. 93112049.7, filed on Jul. 28, 1993.

Minnesota Mining and Manufacturing Company, European Patent Application for "Auditory Prosthesis, Noise Suppression apparatus and Feedback Suppression Apparatus Having focused Adapted Filtering," Application No. 93111138.9, filed on Jul. 12, 1993.

SGS–Thompson Microelectronics, "Adaptive Method to Remove Ghost in Video Signals," European Application No. 93830253.6, filed Jun. 9, 1993.

Topholm & Westermann APS, Process for Controlling a Programmable or Program–Controlled Hearing Aid for its in–situ Fitting Adjustment, International Application No. PCT/EP95/01649, filed May 2, 1995.

Widrow, Bernard, John M. McCook, Michael G. Larimore, and C. Richard Johnson, Jr., "Stationary and Nonstationary Learning Characteristics of the LMS Adaptive Filter," *Proc. IEEE*, vol. 64, No. 8, pp. 1151–1162, Aug. 1976.

Woodruff, Brian D., and David A. Preves, "Fixed Filter Implementation of Feedback Cancellation for In–The–Ear Hearing Aids," *Proc. 1995 IEEE ASSP Workshop on Applications of Signal Processing to Audio and Acoustics*, New Paltz, NY, paper 1.5, 1995.

* cited by examiner

FIGURE 1: PRIOR ART

FIGURE 2: PRIOR ART

FIGURE 3: PRIOR ART

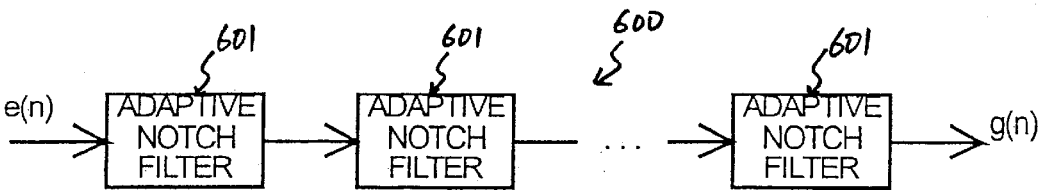
Fig. 6: Cascade of 1 or more adaptive notch filters.
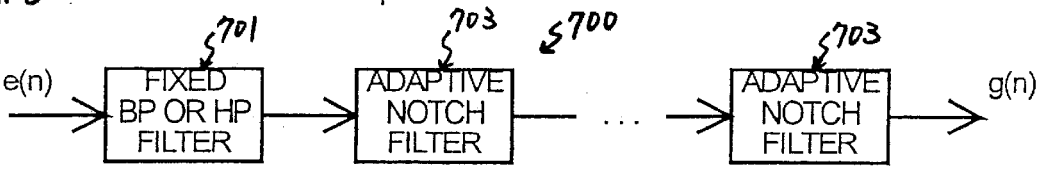
Fig. 7: Cascade of a fixed BP or HP filter with 1 or more adaptive notch filters.
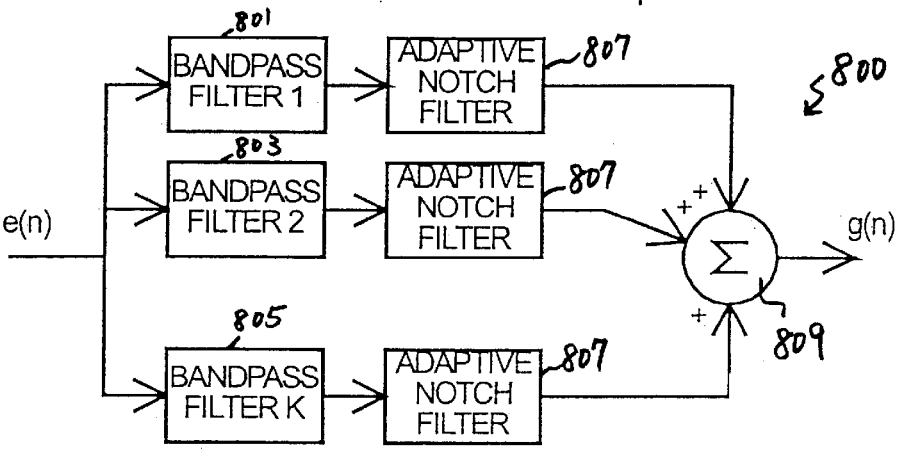
Fig 8: Parallel combination of constrained notch filters.
Use of Notch Filters in the Adaptive Filter Block p(n).

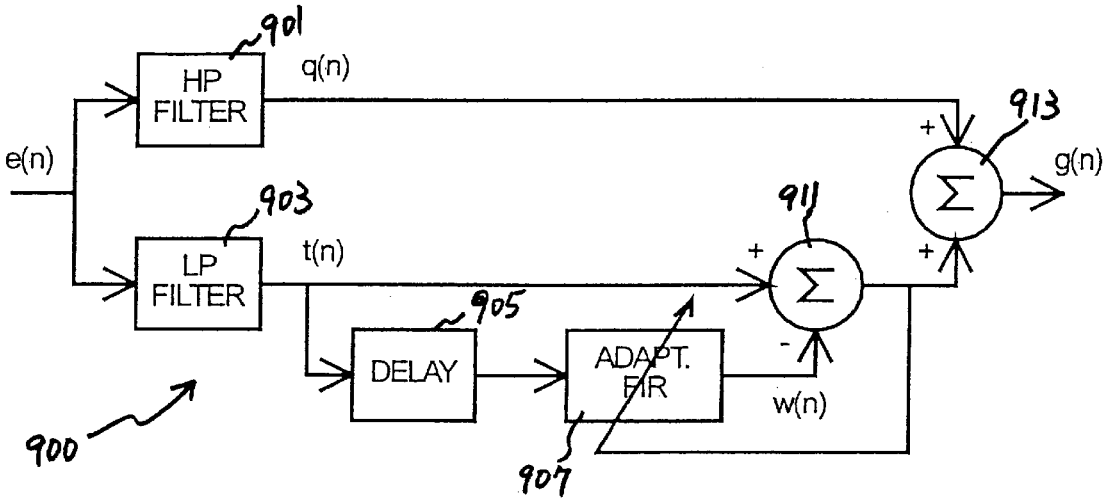
FIGURE 9: Use of an Adaptive Line Enhancer in Filter Block p(n).

FEEDBACK CANCELLATION IN A HEARING AID WITH REDUCED SENSITIVITY TO LOW-FREQUENCY TONAL INPUTS

CROSS-REFERENCES TO RELATED APPLICATION

This application is a continuation-in-part of U.S. patent application Ser. No. 09/745,497, filed Dec. 21, 2000 now U.S. Pat. No. 6,498,858, which is incorporated in its entirety herein by reference for any and all purposes.

FIELD OF THE INVENTION

The present invention relates generally to apparatus and methods for adaptive feedback cancellation in an audio system such as a hearing aid and, more specifically, to a feedback cancellation system of the hearing aid with reduced sensitivity to low-frequency tonal inputs.

BACKGROUND OF THE INVENTION

An audio system, such as a hearing aid, almost invariably incurs some sort of mechanical and/or acoustic feedback during operation of the audio system. The mechanical and/or acoustic feedback often limits the maximum gain that can be achieved in the hearing aid. Moreover, system instability caused by the feedback, whether mechanical and/or acoustic, is sometimes audible as a continuous high-frequency tone or whistle emanating from the hearing aid. The mechanical feedback of the hearing aid is usually caused by mechanical vibrations from a component thereof such as a receiver. Mechanical vibrations from the receiver of a high-power hearing aid can be reduced by combining outputs of two receiver units mounted back-to-back so as to cancel the net mechanical movement of the receiver units. As such, as much as 10 dB additional gain can be achieved for the high-power hearing aid before the onset of oscillation by the hearing aid. Many hearing aids also provide a venting capability to reduce unpleasant occlusion experienced by users of the hearing aids. But venting an earmold of a behind-the-ear (BTE) type hearing aid or a shell of an in-the-ear (ITE) type hearing aid establishes an acoustic feedback path that would limit the maximum possible gain to approximately less than 40 dB for a small vent and even less for a large vent. The acoustic feedback path includes effects from many of the hearing aid components such as the amplifier, receiver, and microphone as well as vent acoustics.

As mentioned, the acoustic feedback of the hearing aid tends to cause system instability of the hearing aid, particularly at high frequencies. A traditional approach for increasing the stability of a hearing aid is to reduce the gain at high frequencies. Reducing the gain of the hearing aid only at high frequencies modifies the overall system frequency response of the hearing aid. Therefore, controlling feedback by modifying the system frequency response to avoid instability means that a desired high-frequency response of the hearing aid will be sacrificed. Phase shifters and notch filters have also been suggested to control feedback, but have not proven to be very effective.

A more effective technique to control feedback is by feedback cancellation. For instance, an internal feedback signal is estimated and subtracted from a microphone signal of the hearing aid. Feedback cancellation typically uses an adaptive filter that models the dynamically changing feedback path of the hearing aid. Such an adaptive feedback cancellation system, however, can generate a large mismatch between an actual feedback path and an adaptive filter modeled feedback path when the input signal of the hearing aid is either narrowband or sinusoidal. One example of such a system has been disclosed by U.S. Pat. No. 5,091,952 to Williamson et al., as is illustrated in FIG. 1. FIG. 1 shows a hearing aid 100 having the adaptive feedback cancellation system incorporated therein. As shown in FIG. 1, an adaptive filter 101 is used to model the feedback path of the hearing aid, and a Least Mean Square (LMS) adaptation algorithm 103 is used to control filter coefficients adaptation of adaptive filter 101. A delay 105 is placed in the feedback path model to decorrelate the hearing aid output from the input. The delay 105 improves the system convergence of the hearing aid for signals such as speech. However, for tonal inputs at low frequencies such as music, sinusoids, or audiological test signals commonly used to measure hearing loss of a patient, this system tends to cancel the tonal inputs instead of accurately modeling the actual feedback path of the hearing aid for feedback cancellation.

An improved effective feedback cancellation scheme used in a hearing aid is disclosed by the present inventor in U.S. Pat. No. 6,072,884, entitled "Feedback Cancellation Apparatus and Methods", the contents of which are incorporated herein by reference. This improved system is illustrated in FIG. 2. The feedback path of such improved system is modeled by the combination of an adaptive filter 201 and a delay 205 plus a slowly-varying or non-varying (frozen) filter 219. The frozen filter 219 can be a frozen IIR filter or a frozen all pole filter, and the adaptive filter 201 can be an adaptive (all zero) FIR filter. Specifically, when the hearing aid is first turned on, filter (pole) coefficients of the frozen filter 219 are adapted to model those aspects of the feedback path that can have high-Q resonance but which stay relatively constant during normal hearing aid operation. Thus, pole coefficients of the feedback path, once determined, are modified and then frozen or, at least, changed vary slowly. Once the pole coefficients are determined, filter (zero) coefficients of the adaptive filter 201 are adapted to correspond to the modified poles. The objective of this adaptation is to minimize an error signal e(n) produced at the output of adder 209. Unlike the filter coefficients of the frozen filter 219, the adaptive filter 201 continues to adapt its filter coefficients in response to changes in the feedback path. Therefore, the adaptive filter 201 models those portions of the feedback path that are changing, and the frozen filter 219 models those portions of the feedback path that remain essentially constant while the hearing aid is in use. This improved system will, however, also attempt to cancel a tonal input signal. Nonetheless, adaptive filter coefficients of this improved system are constrained to prevent excessive deviation from an initial setting thereof. In the presence of a tonal input, the degree of input signal cancellation resulting from the adaptive filter is greatly reduced, but it is still not completely eliminated.

The feedback cancellation systems shown in FIGS. 1 and 2 use the LMS algorithm for adaptation of the adaptive filter coefficients. As shown in FIGS. 1 and 2, the hearing aid receives an input signal x(n), a transfer function of a hearing aid processing unit is given by h(n), and the hearing aid output is y(n), where n is a sample index. The LMS algorithm adaptation in both the above-mentioned feedback cancellation systems uses the cross-correlation of an error signal e(n) and a feedback path signal d(n) that is inputted to the adaptive filter (i.e., the adaptive filter 101 or the adaptive filer 201). The objective of the adaptive filter is to minimize the power of the error signal e(n). Let the adaptive filter be a K-tap finite impulse response (FIR) filter having adaptive coefficients $b_l(n)$ through $b_k(n)$, a power-normalized adaptive filter update for input sample index n is then given by $$b_k(n+1) = b_k(n) + 2\frac{\mu}{\sigma_d^2(n)}e(n)d(n-k) \quad (1)$$

where $\mu$ controls the rate of adaptation and $\sigma_d^2(n)$ is the average power in the feedback path signal d(n). If the input signal x(n) is white noise, the adaptive filter will normally converge to a model of its feedback path. If the input x(n) is a pure tone, however, the adaptive feedback cancellation system will minimize the error signal e(n) by adjusting the filter coefficients $b_l(n)$ through $b_k(n)$ so that v(n), which is an adaptively filtered version of d(n), has the same amplitude and phase as of the input x(n) and thus will cancel the tone. Slowing the rate of adaptation by making $\mu$ smaller will reduce the tendency to cancel short-duration tonal inputs, but will also reduce the ability of the adaptive system to rapidly adapt to large changes to the acoustic feedback path.

A further improvement in feedback cancellation for hearing aids is disclosed by Gao et al. in an international patent application WO 00/019605 A2. This system is illustrated in FIG. 3. As shown in FIG. 3, its feedback path is modeled by the combination of an adaptive filter 301, a delay 305, an LMS adaptation 303, and a frozen filter 319, as previously taught by the above-mentioned '884 patent. In FIG. 3, however, both inputs to the LMS adaptation 303 used to update the adaptive filter coefficients are further filtered through fixed filters p(n) 321 and 323. The fixed filters p(n) 321, 323 are bandpass or highpass filters, and emphasize a frequency region where mismatch between the actual and modeled feedback paths can cause the greatest stability problems in the hearing aid. Low frequencies, where the hearing aid typically has low gain but where tonal input signals are often experienced, are de-emphasized to minimize the possibility of canceling a tonal input. This further improved system relies on the fixed filters p(n) 321, 323 to reduce the potential mismatch when a tonal input is present, and the filter adaptation is not constrained.

In the system of FIG. 3, the cancellation of tonal input signals is reduced by minimizing the power in a filtered version of the error signal instead of minimizing the broadband error. The inputs g(n) and f(n) to LMS adaptation 303 are passed through the respective fixed filters p(n) 321, 323 giving g(n)=e(n)*p(n) and f(n)=d(n)*p(n), where * denotes convolution by the fixed filters p(n) 321, 323. The adaptive coefficient update for input sample n is then given by:

$$b_k(n+1) = b_k(n) + 2\frac{\mu}{\sigma_f^2(n)}g(n)f(n-k), \quad (2)$$

where $\mu$ controls the rate of adaptation and $\sigma_f^2(n)$ is the average power in signal f(n). The use of a highpass filter for p(n), for example, is equivalent to making $\mu$ smaller at low frequencies, thus slowing the rate of adaptation for low-frequency input signals. However, even the system shown in FIG. 3 will tend to cancel a tonal input at low frequencies if the signal duration is long enough.

A need, thus, remains in the art for apparatus and methods to reduce the cancellation of tonal input signals when implementing adaptive feedback cancellation in a hearing aid or other audio system.

SUMMARY OF THE INVENTION

A feedback cancellation system with reduced sensitivity to low-frequency tonal inputs is provided. Such a system can be used, for example, in a hearing aid to prevent cancellation of the desired tonal inputs to the hearing aid, thus improving the gain at high frequencies while simultaneously preserving the desired tonal inputs at low frequencies. The feedback cancellation system comprises a first adaptive filter block for adaptively filtering an error signal to remove the low-frequency tonal components from the error signal. The first adaptive filter block is constrained so that only low-frequency tones in the error signal are cancelled, thus enabling the feedback cancellation system to still cancel "whistling" at high frequencies due to the temporary instability of the hearing aid. A second adaptive filter block adaptively filters the feedback path signal to produce an adaptively filtered feedback path signal. The first and second adaptive filter blocks are identical and filter coefficients of the first adaptive filter block are copied to those of the second adaptive filter block. Using an LMS adaptation algorithm, filter coefficients of the adaptive filer of the feedback cancellation system are controlled by the adaptively filtered error signal and the adaptively filtered feedback path signal respectively inputted from the first and second adaptive filter blocks. The adaptive filter then produces an adaptively filtered modeled feedback signal to be subtracted from an electrical audio signal input for updating the error signal of the hearing aid. The hearing aid processes the updated error signal with a digital signal processor to generate an audio output.

Thus, in one aspect, the invention is an audio processing system such as used in a hearing aid, the audio processing system comprised of a signal path including a digital signal processing means for processing an error signal, and a feedback cancellation means that adaptively models an acoustic feedback path. The feedback cancellation means includes first adaptive filter means adaptively filtering the error signal to remove low-frequency tonal components of the error signal for coefficient adaptation of the acoustic feedback path model, an LMS adaptation means, and an adaptive filter. The filter coefficients of the adaptive filter are adaptively controlled by the adaptively filtered error signal to produced an adaptive feedback signal. Preferably, the signal path of the audio processing system is also comprised of an input transducer, a subtracting means, and an output transducer. In a preferred embodiment, the first adaptive filter means comprises at least one adaptive notch filter. If more than one adaptive notch filters are included in the first adaptive filter means, they are connected in cascade to each other. In another preferred embodiment, the first adaptive filter means comprises a fixed bandpass filter filtering the error signal and connected in cascade to the at least one adaptive notch filter. In yet another preferred embodiment, the first adaptive filter means comprises a fixed highpass filter filtering the error signal and connected in cascade to the at least one adaptive notch filter. In yet another preferred embodiment, the first adaptive filter means comprises a plurality of bandpass filters arranged in parallel combination and respectively receiving the error signal, a plurality of adaptive notch filters also arranged in parallel combination, and adder means for summing outputs of the plurality of adaptive notch filters. Each of the plurality of adaptive notch filters is connected to the output of one of the plurality of bandpass filters. In yet another preferred embodiment, the first adaptive filter means comprises a highpass filter filtering the error signal, a lowpass filter filtering the error signal, a delay delaying the output of the lowpass filter, an adaptive FIR filter adaptively filtering the output of the delay, a first subtracting means for subtracting the output of the adaptive FIR filter from the output of the lowpass filter, and a first adder means for summing the output of the first subtracting means and the output of the highpass filter.

In another aspect, the invention is an audio processing system such as used in a hearing aid, the audio processing system comprised of a signal path including a digital signal processing means for processing an error signal, and a feedback cancellation means that adaptively models an acoustic feedback path. The feedback cancellation means includes first adaptive filter means adaptively filtering the error signal to remove low-frequency tonal components of the error signal for coefficient adaptation of the acoustic feedback path model, second adaptive filter means for adaptive filtering a feedback path signal, an LMS adaptation means, and an adaptive filter. The filter coefficients of the adaptive filter are adaptively controlled by the adaptively filtered error signal and by the adaptively filtered feedback path signal to produced an adaptive feedback signal. The first and second adaptive filter means are identical and filter coefficients of first adaptive filter means are copied to those of the second adaptive filter means. Preferably, the signal path of the audio processing system is also comprised of an input transducer, a subtracting means, and an output transducer. In a preferred embodiment, the first adaptive filter means comprises at least one adaptive notch filter. If more than one adaptive notch filters are included in the adaptive filter means, they are connected in cascade to each other. In another preferred embodiment, the first adaptive filter means comprises a fixed bandpass filter filtering the error signal and connected in cascade to the at least one adaptive notch filter. In yet another preferred embodiment, the first adaptive filter means comprises a fixed highpass filter filtering the error signal and connected in cascade to the at least one adaptive notch filter. In yet another preferred embodiment, the first adaptive filter means comprises a plurality of bandpass filters arranged in parallel combination and respectively receiving the error signal, a plurality of adaptive notch filters also arranged in parallel combination, and adder means for summing outputs of the plurality of adaptive notch filters. Each of the plurality of adaptive notch filters is connected to the output of one of the plurality of bandpass filters. In yet another preferred embodiment, the first adaptive filter means comprises a highpass filter filtering the error signal, a lowpass filter filtering the error signal, a delay delaying the output of the lowpass filter, an adaptive FIR filter adaptively filtering the output of the delay, a first subtracting means for subtracting the output of the adaptive FIR filter from the output of the lowpass filter, and a first adder means for summing the output of the first subtracting means and the output of the highpass filter.

In yet another aspect, the invention is a method of feedback cancellation, such as used in a hearing aid, the method comprising the steps of receiving an input signal, generating an electrical audio signal in accordance with the input signal, processing the electrical audio signal by a digital signal processor to produce an electrical output signal, estimating an internal feedback signal in accordance with the electrical output signal, generating an error signal by subtracting the internal feedback signal from the electrical audio signal, adaptively filtering the error signal to remove low-frequency tonal components of the error signal with a first adaptive filter block, adaptively controlling filter coefficients of an adaptive filter in accordance with the adaptively filtered error signal, updating the internal feedback signal by the adaptive filter, updating the error signal by subtracting the updated internal feedback signal from the electrical audio signal, and processing the updated error signal by the digital signal processor to update the electrical output signal. In a preferred embodiment, the step of adaptively filtering the error signal is accomplished by filtering the error signal with at least one adaptive notch filter of the first adaptive filter block. In another embodiment, the step of adaptively filtering the error signal is accomplished by filtering the error signal with a bandpass filter and then with the at least one adaptive notch filter. In yet another embodiment, the step of adaptively filtering the error signal is accomplished by filtering the error signal with a highpass filter and then with the at least one adaptive notch filter. In yet another embodiment, the step of adaptively filtering the error signal comprises the steps of filtering the error signal with a plurality of bandpass filters arranged in parallel combination, filtering outputs of the plurality of bandpass filters with a plurality of adaptive notch filters also arrange in parallel combination, and generating the adaptively filtered error signal by summing outputs of the plurality of adaptive notch filters. In yet another embodiment, the step of adaptively filtering the error signal comprises the steps of generating a highpass error signal by filtering the error signal with a highpass filter, generating a lowpass filtered error signal by filtering the error signal with a lowpass filter, delaying the lowpass filtered error signal, generating an adaptively filtered lowpass error signal by filtering the delayed lowpass filtered error signal with an adaptive FIR filter, generating a lowpass error signal by subtracting the adaptively filtered lowpass error signal from the lowpass filtered error signal, and generating the adaptively filtered error signal by summing the lowpass error signal and the highpass error signal.

In yet another aspect, the invention is a method of feedback cancellation, such as used in a hearing aid, the method comprising the steps of receiving an input signal, generating an electrical audio signal in accordance with the input signal, processing the electrical audio signal by a digital signal processor to produce an electrical output signal, estimating an internal feedback signal in accordance with the electrical output signal, generating an error signal by subtracting the internal feedback signal from the electrical audio signal, adaptively filtering the error signal to remove low-frequency tonal components of the error signal with a first adaptive filter block, delaying the electrical output signal with a delay unit, generating a feedback path signal by filtering an output of the delay unit with a frozen filter, generating an adaptive feedback path signal by filtering the feedback path signal with a second adaptive filter block, adaptively controlling filter coefficients of an adaptive filter in accordance with the adaptively filtered error signal and the adaptively filtered feedback path signal, updating the internal feedback signal by the adaptive filter, updating the error signal by subtracting the updated internal feedback signal from the electrical audio signal, and processing the updated error signal by the digital signal processor to update the electrical output signal. In a preferred embodiment, the step of adaptively filtering the error signal is accomplished by filtering the error signal with at least one adaptive notch filter of the first adaptive filter block. In another embodiment, the step of adaptively filtering the error signal is accomplished by filtering the error signal with a bandpass filter and then with the at least one adaptive notch filter. In yet another embodiment, the step of adaptively filtering the error signal is accomplished by filtering the error signal with a highpass filter and then with the at least one adaptive notch filter. In yet another embodiment, the step of adaptively filtering the error signal comprises the steps of filtering the error signal with a plurality of bandpass filters arranged in parallel combination, filtering outputs of the plurality of bandpass filters with a plurality of adaptive notch filters also arrange in parallel combination, and generating the adaptively filtered error signal by summing outputs of the plurality of adaptive notch filters. In yet another embodiment, the step of adaptively filtering the error signal comprises the steps of generating a highpass error signal by filtering the error signal with a highpass filter, generating a lowpass filtered error signal by filtering the error signal with a lowpass filter, delaying the lowpass filtered error signal, generating an adaptively filtered lowpass error signal by filtering the delayed lowpass filtered error signal with an adaptive FIR filter, generating a lowpass error signal by subtracting the adaptively filtered lowpass error signal from the lowpass filtered error signal, and generating the adaptively filtered error signal by summing the lowpass error signal and the highpass error signal.

A further understanding of the nature and advantages of the present invention may be realized by reference to the remaining portions of the specification and the drawings.

BRIEF DESCRIPTION OF THE DRAWINGS

FIG. 6 illustrates a cascade of adaptive notch filters used in the adaptive filter block p(n) shown in FIG. 4;

FIG. 7 illustrates a cascade of a fixed filter with adaptive notch filters used in the adaptive filter block p(n) shown in FIG. 4;

FIG. 8 illustrates a parallel combination of constrained notch filters used in the adaptive filter block p(n) shown in FIG. 4; and FIG. 9 illustrates an adaptive line enhancer in the adaptive filter block p(n) shown in FIG. 4.

DESCRIPTION OF THE PREFERRED EMBODIMENT

Figure 4:
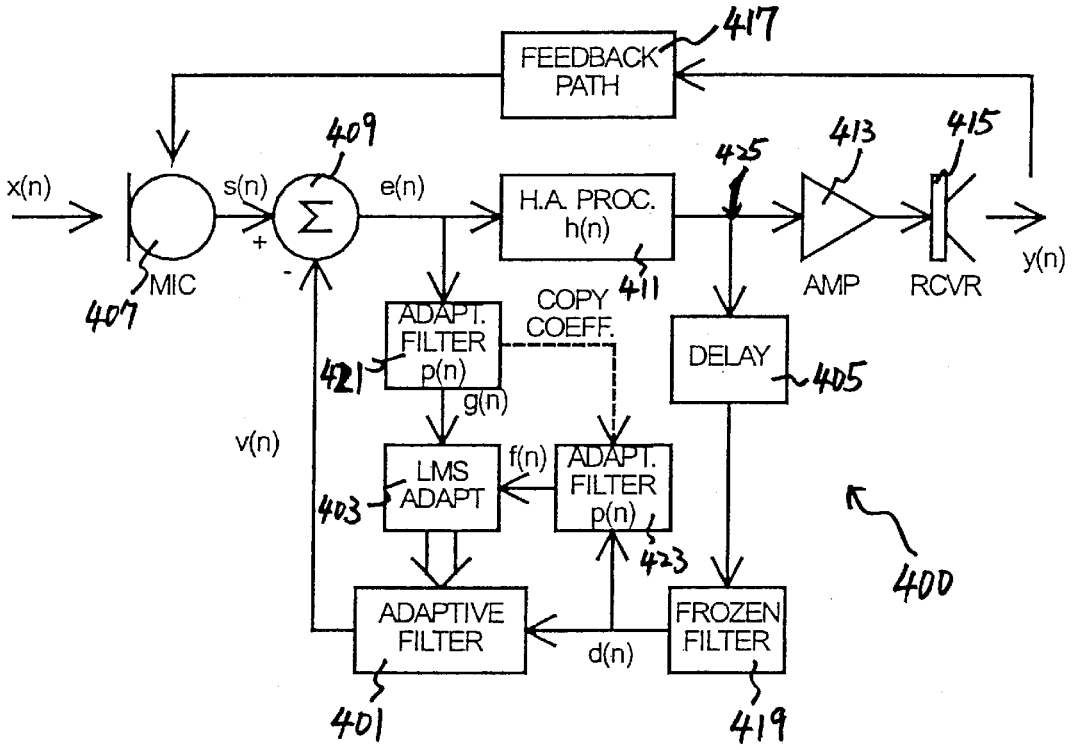
FIG. 4 illustrates a hearing aid with a feedback cancellation system according to the present invention.

FIG. 4 shows a simplified block diagram of hearing aid 400 according to a preferred embodiment of the present invention. It is also understood that the feedback cancellation system of the present invention can be used in other applications, such as audio systems, audio broadcasting systems, telephony, and the like. It should also be understood that hearing aid 400 can be an in-the-canal, in-the-ear, behind-the-ear, or otherwise mounted hearing aid.

The hearing aid 400 includes microphone 407 for receiving an input signal x(n), and a feedback signal via acoustic feedback path 417 of the hearing aid, to produce an electrical audio signal s(n), where n is a sample index. An adaptively filtered feedback signal v(n) outputted from adaptive filter 401 is subtracted from the electrical audio signal s(n) by adder 409 to produce an error signal e(n). The error signal e(n) is inputted into hearing aid processing unit 411, which is a digital signal processor, to generate electrical output 425. The electrical output 425 of hearing aid processing unit 411 is amplified by amplifier 413 and then converted into an audio output y(n) by receiver 415. The audio output y(n) is fed back to microphone 407 via acoustic feedback path 417.

The electrical output 425 of hearing aid processing unit 411 is shifted in time by delay 405 and then filtered by frozen filter 419 to generate a feedback path signal d(n). The frozen filter 419 is a slowing-varying or non-varying (frozen) filter. The feedback path signal d(n) from the frozen filter 419 is inputted into adaptive filter 401 for generating the adaptively filtered feedback signal v(n). The frozen filter 419 can be a frozen all-pole filter or a frozen IIR filter, and the adaptive filter 401 can be an adaptive (all-zero) FIR filter. Specifically, when the hearing aid 400 is first turned on, filter (pole) coefficients of the frozen filter 419 are adapted to model those aspects of the feedback path that can have high-Q resonance but which stay relatively constant during normal hearing aid operation. Thus, pole coefficients of the feedback path, once determined, are modified and then frozen or, at least, changed vary slowly. Once the pole coefficients are determined, filter (zero) coefficients of the adaptive filter 401 are adapted to correspond to the modified poles. The objective of this adaptation is to minimize the error signal e(n) produced at the output of adder 409. Unlike the filter coefficients of the frozen filter 419, the adaptive filter 401 continues to adapt its filter coefficients in response to changes in the feedback path. Therefore, the adaptive filter 401 models those portions of the feedback path that are changing, and the frozen filter 419 models those portions of the feedback path that remain essentially constant while the hearing aid is in use.

Figure 1:
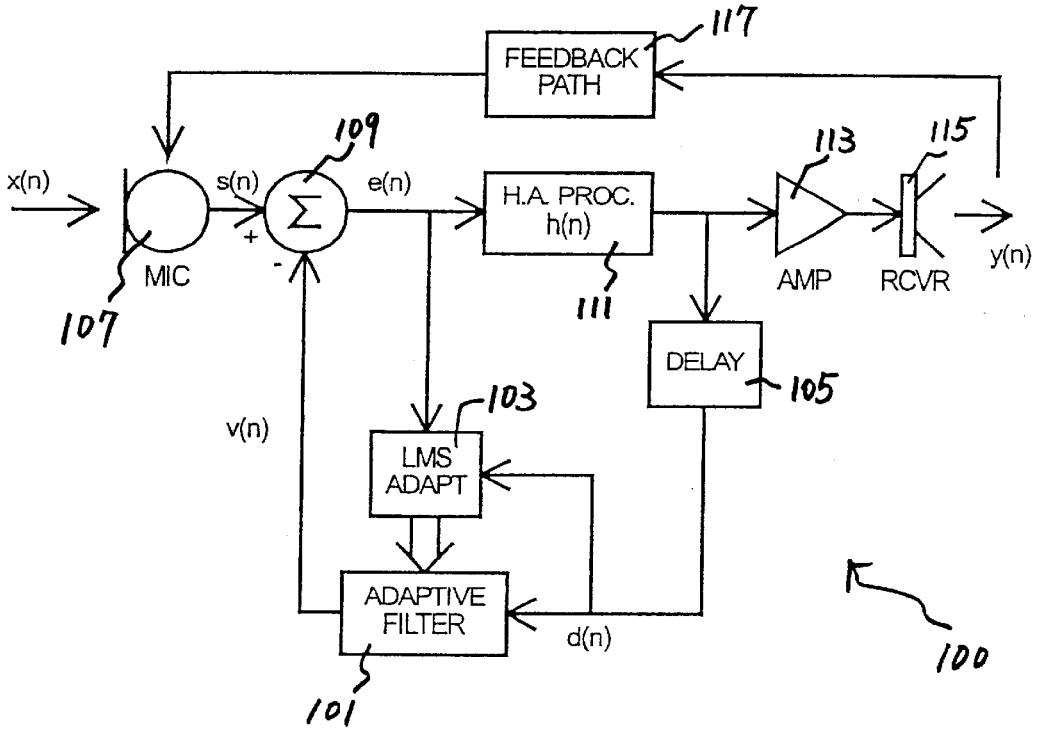
FIG. 1 illustrates a hearing aid having an adaptive feedback cancellation system according to the prior art.
Figure 2:
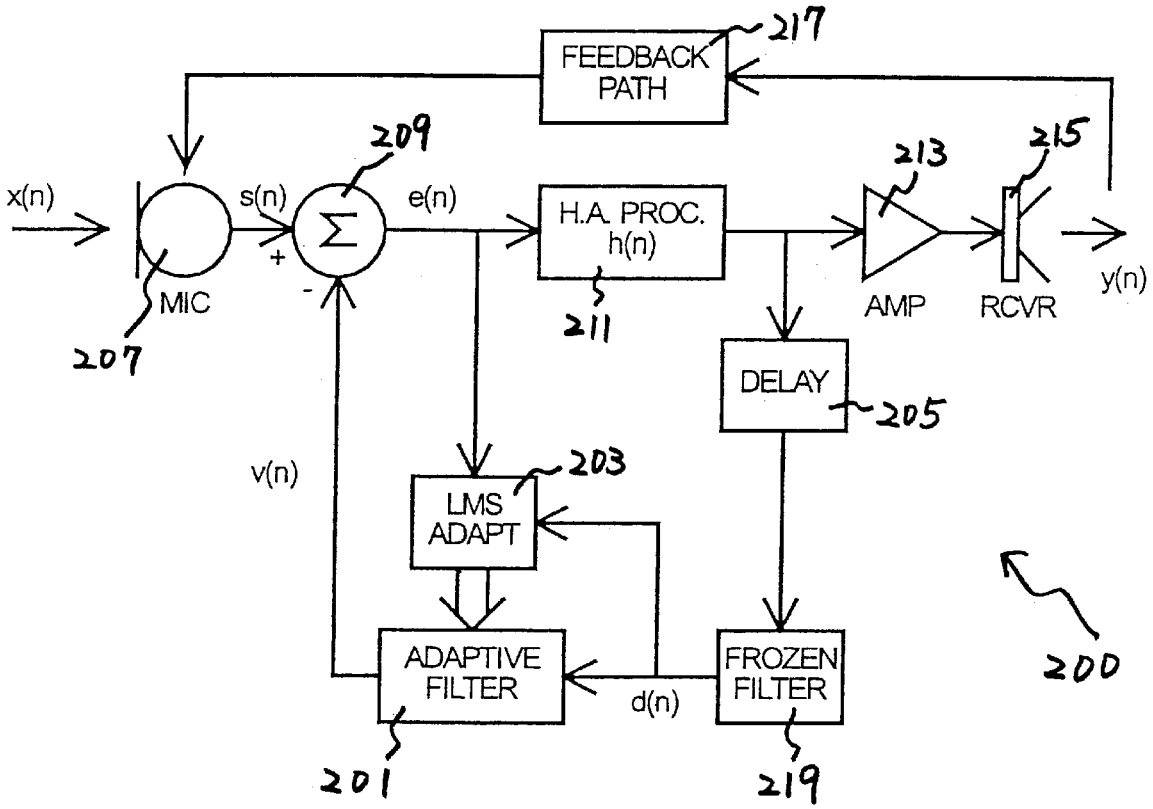
FIG. 2 illustrates a hearing aid having an improved feedback cancellation scheme according to a second prior art.
Figure 3:
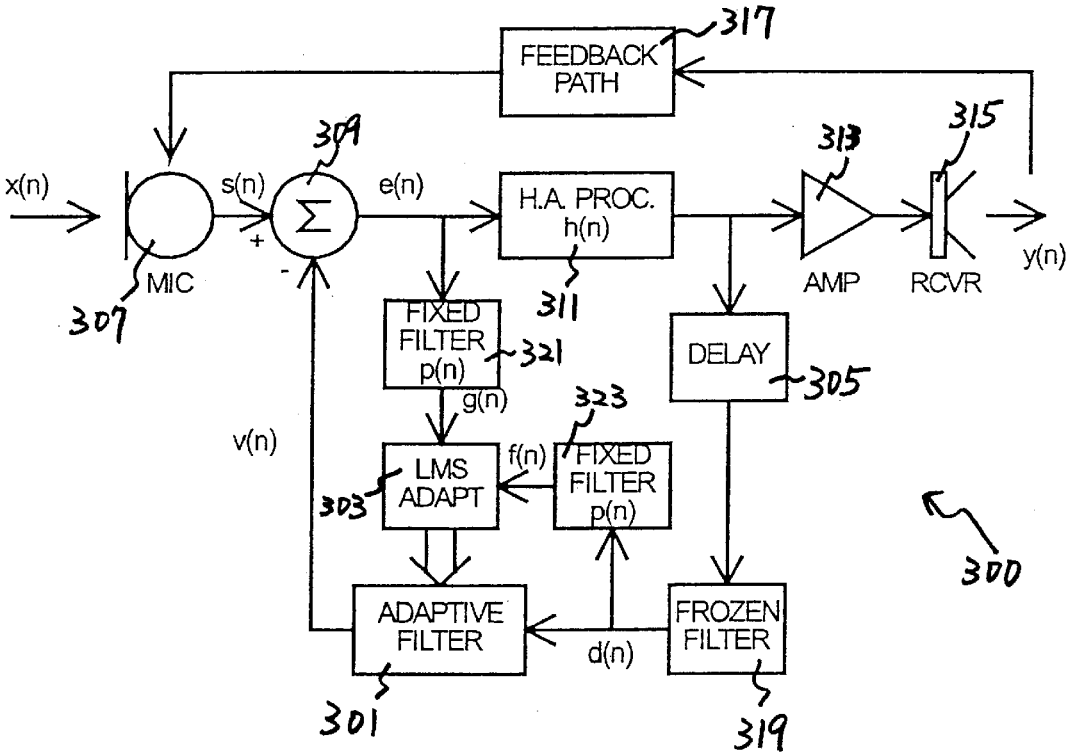
FIG. 3 illustrates yet another improved feedback cancellation scheme of a hearing aid according to a third prior art.

The hearing aid 400 further includes first and second adaptive filter blocks p(n) 421, 423, as compared to fixed filters p(n) 321, 323 of the prior art shown in FIG. 3. The first adaptive filter block p(n) 421 adapts to minimize the power of the error signal e(n) by generating a filtered error signal g(n) at its output. In the preferred embodiment of the present invention, the filtered error signal g(n) forms a first input to Least Mean Square (LMS) adaptation 403 of the feedback path model. In other embodiments, the LMS adaptation 403 may be replaced by other suitable adaptation algorithms. For instance, more sophisticated adaptation algorithms may offer faster convergence to the hearing aid. Such algorithms, however, generally require much greater amounts of computation and therefore may not be as practical for a hearing aid. Filter coefficients of first adaptive filter block p(n) 421 are copied to second adaptive filter block p(n) 423, which modifies the feedback path signal d(n) to produce filtered feedback path signal f(n) as a second input to LMS adaptation 403. The second adaptive filter block p(n) 423 is identical to the first adaptive filter block p(n) 421. The LMS adaptation 403 controls adaptation of the filter coefficients of adaptive filter 401.

Figure 5:
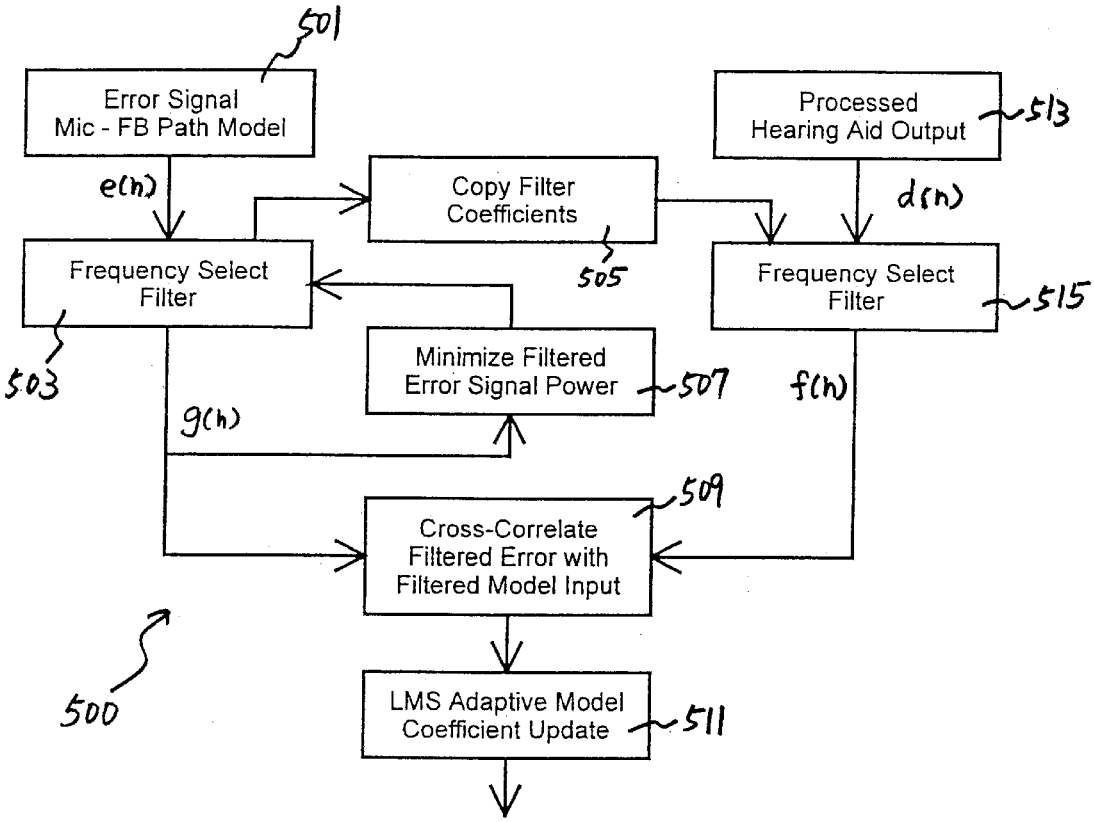
FIG. 5 illustrates a signal flow chart of the adaptation of the feedback model.

A simplified signal flow chart of a feedback model adaptation according to the present invention is illustrated in FIG. 5. As shown in FIG. 5, the hearing aid 400 in step 501 generates the error signal e(n) using a Microphone-Feedback Path model. In step 503, the error signal e(n) is inputted into a first frequency select filter, which is the first adaptive filter block p(n) 421 shown in FIG. 4, to generate the filtered error signal g(n). In step 507, the filtered error signal g(n) is sensed and analyzed and the filter coefficients of the first frequency select filter are updated to minimize the power of the filtered error signal g(n). The filter coefficients of the first frequency select filter are copied to a second frequency select filter, which is the second adaptive filter block p(n) 423, in step 505.

In step 513, hearing aid processing unit 411 processes the error signal e(n) to generate electrical output 425, which is then tapped by delay 405 and filtered by frozen filter 419 to generate the feedback path signal d(n). The feedback path signal d(n) is filtered in step 515 by the second frequency select filter to generate filtered feedback path signal f(n). As mentioned, the filter coefficients of the second frequency select filter are copied and updated from the first frequency select filter during step 505. Subsequently, in step 509, the g(n) and the f(n) are cross-correlated by LMS adaptation 403. The LMS adaptation 403 then generates adaptive model coefficient update for adaptively updating the filter coefficients of adaptive filter 401 in step 511.

There are several ways in which the first and second adaptive filter blocks p(n) 421, 423 can be designed, as shown in FIGS. 6–9. FIG. 6 illustrates a preferred embodiment of the first adaptive filter block p(n) 421 or the second adaptive filter block p(n) 423 according to the present invention. As shown in FIG. 6, the first adaptive filter block p(n) 421 includes a cascade of adaptive digital notch filters 601 connected in series to each other. Although FIG. 6 indicates that three or more adaptive digital notch filters 601 are included in the adaptive filter block p(n), as few as only one adaptive digital notch filter 601 can be sufficient for the first and second adaptive filter blocks p(n) 421, 423. A digital notch filter 601 is generally given by the transfer function $$N(z) = \frac{1 - 2r\cos(\omega_o)z^{-1} + r^2 z^{-2}}{1 - 2\rho r\cos(\omega_o)z^{-1} + (\rho r)^2 z^{-2}} \tag{3}$$

where r is the pole radius, $\omega_o$ is the notch center frequency in radians, and ρ controls the notch width of the digital notch filter 601. According to the preferred embodiment, parameter values found to be effective in practice for the preferred embodiment are r=0.99, ρ=0.5, and a constraint applied to limit $0 \leqq \omega_o \leqq \pi/4$ for a system having a 16-kHz digital sampling rate. Other parameter values can also be used under different conditions or considerations. In general, the adaptive digital notch filter 601 can be designed by setting r and ρ to pre-selected values of less than 1, and adapting the remaining parameter $\cos(\omega_o)$ to control a notch center frequency of the adaptive digital notch filter 601. More preferably, the pole radius r is set to within the range of $0.5 \leqq r \leqq 1$ and the value of ρ is set to within the range of $0.3 \leqq \rho \leqq 0.7$.

If we let $c(n) \equiv \cos(\omega_o)$ for sample index n, and define e(n) as an input to the adaptive notch filter 601 and g(n) as the output, then the adaptive notch filter 601 is given by:

$$u(n) = e(n) + 2\rho r c(n) u(n-1) - (\rho r)^2 u(n-2) \tag{4}$$

$$g(n) = u(n) - 2rc(n)u(n-1) + r^2 u(n-2)$$

$$c(n+1) = c(n) + 2\mu r g(n) u(n-1)$$

where u(n) is an output from filtering with just the pole pair, g(n) is the result of then filtering with the zero pair, and $\mu$ controls the rate of adaptation of the notch center frequency. Typically, the notch center frequency is constrained so that $0.707 \leqq c(n) \leqq 1$. The adaptive notch filter 601 cancels low frequency tones in the error signal e(n), and the constraint on c(n) ensures that the adaptive feedback cancellation system of the hearing aid 400 cancels only low-frequency tonal components of the error signal e(n). High-frequency tones are not canceled, so the feedback cancellation system will still remove "whistling" caused by momentary instability in hearing aid 400. Furthermore, the ability of the presently described feedback cancellation system to adjust to changes in the feedback path at high frequencies is not affected by the adaptive notch filter 601 due to the constraint on the center frequency thereof. More than one adaptive notch filter 601 can be used in series, with each notch filter 601 tending to cancel a different sinusoid in the error signal e(n).

FIG. 7 shows another preferred embodiment of the first adaptive filter block p(n) 421 or the second adaptive filter block p(n) 423. In FIG. 7, one or more identical adaptive notch filters 703 are combined in cascade with fixed initial filter 701. Similar to the embodiment shown in FIG. 6, as few as only one adaptive notch filter 703 can be sufficient for the first and second adaptive filter blocks p(n) 421, 423. For the first adaptive filter block p(n) 421, the fixed initial filter 701 is inputted with the error signal e(n). Moreover, the fixed initial filter 701 can be a bandpass or highpass filter. The fixed initial filter 701 removes much of the low-frequency power in the error signal e(n), thereby reducing the possibility of feedback cancellation artifacts caused by a low frequency tonal input such as speech or music. The adaptive notch filter 703 then removes any remaining low-frequency sinusoids, thus further reducing the occurrence of processing artifacts. Like the adaptive notch filter 601 shown in FIG. 6, the adaptive notch filter 701 has constraint on its notch filter center frequency. Again, the constraint on the notch filter center frequency allows the feedback cancellation system to adjust to any changes in the feedback path that occur at high frequencies.

FIG. 8 shows yet another preferred embodiment of the first adaptive filter block p(n) 421 or the second adaptive filter block p(n) 423 according to the present invention. As shown in FIG. 8, the error signal e(n) is inputted into a parallel combination of K fixed bandpass filters 801, 803, . . . 805, where K is the number of the bandpass filters. Each fixed bandpass filter independently operates to pass a specific frequency band of the error signal e(n). An output of each of the K fixed bandpass filters 801, 803, . . . 805 is coupled to a corresponding adaptive notch filter 807, respectively. Accordingly, each adaptive notch filter 807 is constrained to operate in a separate frequency region, and adapts to minimize the error signal power in that frequency band. The adaptation of each adaptive notch filter 807 is independent, and the notch depth and bandwidth can be adjusted to optimize the performance of the ensemble of filters. The filtered error signal g(n) is then the sum of output signals filtered by the notch filters 807 in all frequency bands.

FIG. 9 shows yet another preferred embodiment of the first adaptive filter block p(n) 421 or the second adaptive filter block p(n) 423. As shown in FIG. 9, adaptive FIR filter 907 is used to cancel low frequency tones instead of using an adaptive notch filter. In another embodiment, an IIR filter can be used as the adaptive filter 907. A pair of initial filters is used to separate frequency ranges of the error signal e(n) received by the adaptive filter block p(n) 421 or 423. In FIG. 9, lowpass filter 903 and highpass filter 901 receive the error signal e(n) at their inputs and produce lowpass and highpass filtered error signals t(n) and q(n) at their outputs, respectively. The lowpass filtered error signal t(n) is shifted in time by delay 905 and then is filtered by adaptive FIR filter 907 to produce adaptively filtered error signal w(n). The adaptively filtered error signal w(n) is subtracted from the lowpass filtered error signal t(n) by adder 911, and the output of adder 911 is then added to the highpass filtered error signal q(n) to generate the filtered error signal g(n) of the adaptive filter block p(n) 421 or 423. The high frequencies in the error signal e(n) are not modified, thus allowing the feedback cancellation system to adapt to changes in the feedback path at high frequencies. However, tonal components are removed from the low-frequency portion of the lowpass filtered error signal t(n) due to delay 905 and adaptive FIR filter 907. As a result, the adaptive filter block p(n) 421 or 423 is controlled by a difference signal t(n)-w(n), and the adaptation minimizes the power in this difference signal. Because delay 905 decorrelates the low-frequency error signal w(n) passed through adaptive FIR filter 907 with respect to the low-frequency error signal t(n) that is not filtered by adaptive FIR filter 907, the adaptive FIR filter 907 will not cancel low-frequency noises or random inputs. Tones in the low-frequency error signal t(n) remain correlated with the error signal w(n) despite the delay, however, so the first adaptive filter block p(n) 421 will cause the cancellation of tonal portions of a low-frequency signal. Such result is a system that cancels low-frequency tonal components of an error signal while leaving the high-frequency portion of the error signal unmodified. Since the low-frequency tonal components of the error signal e(n) are removed prior to the LMS adaptation of filter coefficients of the adaptive filter 401, the adaptively filtered feedback signal v(n) generated by the adaptive filter 401 contains no low-frequency tonal components of the input signal. Therefore, when the adaptively filtered feedback signal v(n) is subtracted from the electrical audio signal s(n) by adder 409 to generate the error signal e(n), the tonal components of the electrical audio signal s(n) will not be cancelled and the low-frequency response of the hearing aid 400 will not be sacrificed. The system illustrated in FIG. 9 will typically require a much greater amount of computation than those of FIGS. 6–8, so the embodiments given by FIGS. 6–8 are often preferred in practice. However, the system illustrated in FIG. 9 generally would generate a more accurate result as compared to those systems illustrated in FIGS. 6–8 in canceling the low-frequency tonal components of an error signal while leaving the high-frequency portion of the error signal unmodified. Moreover, since the system illustrated in FIG. 9 will not cancel low-frequency noises or random inputs, these low frequency noises or random inputs are included in the adaptively filtered feedback signal v(n). As a result, the low frequency noises and/or the random inputs may be removed from the error signal e(n) due to the system illustrated in FIG. 9.

As will be understood by those familiar with the art, the present invention may be embodied in other specific forms without departing from the spirit or essential characteristics thereof. Accordingly, the disclosures and descriptions herein are intended only to be illustrative, but not limiting, of the scope of the invention which is set forth in the following claims.

What is claimed is:

1. A hearing aid, comprising:

a signal path capable of receiving an audio input signal and an acoustic feedback signal from an acoustic feedback path and of generating an audio output signal, said signal path having subtracting means for generating an error signal; and feedback cancellation means adapted to adaptively model the acoustic feedback path for canceling the acoustic feedback signal, wherein said feedback cancellation means comprises a first adaptive filter means for adaptively filtering the error signal from said signal path to remove low-frequency tonal components of the error signal during coefficient adaptation of the acoustic feedback path model, said first adaptive filter means removing the low-frequency tonal components from the error signal for preserving the low-frequency tonal components in the audio output signal.

2. The hearing aid of claim 1, wherein said first adaptive filter means comprises at least one adaptive notch filter.

3. The hearing aid of claim 2, wherein said at least one adaptive notch filter includes two or more adaptive notch filters connected in cascade to each other.

4. The hearing aid of claim 2, wherein said first adaptive filter means further comprises a bandpass filter filtering the error signal and connected in series to said at least one adaptive notch filter.

5. The hearing aid of claim 2, wherein said first adaptive filter means further comprises a highpass filter filtering the error signal and connected in series to said at least one adaptive notch filter.

6. The hearing aid of claim 2, wherein a center frequency of each adaptive notch filter of said at least one adaptive notch filter is constrained to between 0 Hz and a predetermined maximum allowable frequency.

7. The hearing aid of claim 1, wherein said first adaptive filter means includes a plurality of adaptive notch filters arranged in parallel combination, said first adaptive filter means further comprising:

a plurality of bandpass filters arranged in parallel combination, each of said plurality of bandpass filters filtering the error signal and being coupled to one of said plurality of adaptive notch filters; and adder means for summing outputs of said plurality of adaptive notch filters.

8. The hearing aid of claim 1, wherein said first adaptive filter means comprises an adaptive FIR filter for canceling the low-frequency tonal components of the error signal.

9. The hearing aid of claim 8, wherein said first adaptive filter means further comprises:

a highpass filter, said highpass filter filtering the error signal from said signal path to generate a highpass filtered error signal; and a lowpass filter, said lowpass filter filtering the error signal from said signal path to generate a lowpass filtered error signal, wherein said adaptive FIR filter causes low-frequency tonal components to be removed from the lowpass filtered error signal.

10. The hearing aid of claim 9, wherein said first adaptive filter means further comprises:

a delay unit, said delay unit being coupled between said lowpass filter and said adaptive FIR filter for delaying the lowpass filtered error signal inputted into said adaptive FIR filter;

first subtracting means, coupled to said lowpass filter and said adaptive FIR filter, for subtracting an output of said adaptive FIR filter from the lowpass filtered error signal; and first adder means, coupled to said highpass filter and said first subtracting means, for summing the highpass filtered error signal with an output of said first subtracting means.

11. The hearing aid of claim 1, wherein said feedback cancellation means further comprises second adaptive filter means adaptively filtering a feedback path signal for coefficient adaptation of the acoustic feedback path model, said second adaptive filter means being identical to said first adaptive filter means.

12. The hearing aid of claim 11, wherein said feedback cancellation means further comprises:

an adaptive filter, said adaptive filter generating an adaptively filtered feedback signal in accordance with the feedback path signal to the subtracting means; and LMS adaptation means, coupled to said adaptive filter and said first and second adaptive filter means, for controlling adaptation of filter coefficients of said adaptive filter.

13. The hearing aid of claim 12, wherein said feedback cancellation means further comprises:

a feedback delay unit coupled to said signal path; and frozen filter means, coupled to said feedback delay unit, for generating the feedback path signal to said second adaptive filter means and said adaptive filter.

14. The hearing aid of claim 13, wherein said signal path further comprises hearing aid processing means for processing the error signal, said feedback delay unit of said feedback cancellation means coupled to said hearing aid processing means for receiving an output therefrom.

15. The hearing aid of claim 11, wherein filter coefficients of said second adaptive filter means are copied from filter coefficients of said first adaptive filter means.

16. A hearing aid, comprising:

a microphone, said microphone being adapted to receive an input audio signal and an acoustic feedback signal and generate an electrical audio signal;

feedback cancellation means for canceling the acoustic feedback signal, said feedback cancellation means generating a signal processing feedback signal in response to a feedback path signal;

subtracting means, coupled to said microphone and said feedback cancellation means, for subtracting the signal processing feedback signal from the electrical audio signal to form a compensated electrical audio signal;

hearing aid processing means, coupled to said subtracting means, for processing the compensated electrical audio signal; and receiver means, coupled to said hearing aid processing means, for converting the processed compensated electrical audio signal into a sound signal, wherein said feedback cancellation means adaptively models an acoustic feedback path and includes first adaptive filter means for adaptively filtering the compensated electrical audio signal to remove low-frequency tonal components of the compensated electrical audio signal for coefficient adaptation of the acoustic feedback path model.

17. The hearing aid of claim 16, wherein said first adaptive filter means comprises at least one adaptive notch filter.

18. The hearing aid of claim 17, wherein said at least one adaptive notch filter includes two or more adaptive notch filters connected in cascade to each other.

19. The hearing aid of claim 17, wherein said first adaptive filter means further comprises a bandpass filter filtering the compensated electrical audio signal and connected in series to said at least one adaptive notch filter.

20. The hearing aid of claim 17, wherein said first adaptive filter means further comprises a highpass filter filtering the compensated electrical audio signal and connected in series to said at least one adaptive notch filter.

21. The hearing aid of claim 17, wherein a center frequency of each adaptive notch filter of said at least one adaptive notch filter is constrained to between 0 Hz and a predetermined maximum allowable frequency.

22. The hearing aid of claim 16, wherein said first adaptive filter means comprises a plurality of adaptive notch filters arranged in parallel combination, said first adaptive filter means further comprising:

a plurality of bandpass filters arranged in parallel combination, each of said plurality of bandpass filters filtering the compensated electrical audio signal and being coupled to one of said plurality of adaptive notch filters; and adder means for summing outputs of said plurality of adaptive notch filters.

23. The hearing aid of claim 16, wherein said first adaptive filter means comprises:

an adaptive FIR filter;

a highpass filter, said highpass filter filtering the compensated electrical audio signal to generate a highpass filtered error signal;

a lowpass filter, said lowpass filter filtering the compensated electrical audio signal to generate a lowpass filtered error signal, a delay unit, said delay unit being coupled between said lowpass filter and said adaptive FIR filter for delaying the lowpass filtered error signal inputted into said adaptive FIR filter;

first subtracting means, coupled to said lowpass filter and said adaptive FIR filter, for subtracting an output of said adaptive FIR filter from the lowpass filtered error signal; and first adder means, coupled to said highpass filter and said first subtracting means, for summing the highpass filtered error signal with an output of said first subtracting means.

24. The hearing aid of claim 16, wherein said feedback cancellation means further comprises second adaptive filter means adaptively filtering the feedback path signal for coefficient adaptation of the acoustic feedback path model, said second adaptive filter means being identical to said first adaptive filter means.

25. The hearing aid of claim 24, wherein said feedback cancellation means further comprises:

an adaptive filter, said adaptive filter generating the signal processing feedback signal to said subtracting means;

LMS adaptive means, coupled to said adaptive filter and said first and second adaptive filter means, for controlling adaptation of filter coefficients of said adaptive filter;

a feedback delay unit coupled to an output of said hearing aid processing means; and frozen filter means, coupled to said feedback delay unit, for generating the feedback path signal to said second adaptive filter means and said adaptive filter.

26. The hearing aid of claim 24, wherein filter coefficients of said second adaptive filer means are copied from filter coefficients of said first adaptive filter means.

27. A method for compensating feedback noise in an audio system, comprising the steps of:

receiving an input signal;

generating an electrical audio signal in accordance with the input signal;

processing the electrical audio signal by a digital signal processor to produce an electrical output signal;

estimating a modeled feedback signal in accordance with the electrical output signal;

generating an error signal by subtracting the modeled feedback signal from the electrical audio signal;

adaptively filtering the error signal to remove low-frequency tonal components of the error signal with a first adaptive filter block;

adaptively controlling filter coefficients of an adaptive filter in accordance with the adaptively filtered error signal;

updating the modeled feedback signal by the adaptive filter;

updating the error signal by subtracting the updated modeled feedback signal from the electrical audio signal; and processing the updated error signal by the digital signal processor to update the electrical output signal.

28. The method according to claim 27, wherein the step of adaptively filtering the error signal is accomplished by adaptively filtering the error signal with at least one adaptive notch filter of the first adaptive filter block.

29. The method according to claim 28, wherein the at least one adaptive notch filter includes two or more adaptive notch filters arranged in cascade to each other.

30. The method according to claim 28, wherein the step of adaptively filtering the error signal further comprises a step of filtering the error signal with a bandpass filter prior to the at least one adaptive notch filter.

31. The method according to claim 28, wherein the step of adaptively filtering the error signal further comprises a step of filtering the error signal with a highpass filter prior to the at least one adaptive notch filter.

32. The method according to claim 27, wherein the step of adaptively filtering the error signal comprises the steps of:

filtering the error signal by a plurality of bandpass filters arranged in parallel combination, each of the plurality of bandpass filters being adapted to filter a specific range of the error signal frequency;

filtering outputs of the plurality of bandpass filters by a plurality of adaptive notch filters, each of the plurality of adaptive notch filters being coupled to one of the plurality of bandpass filters; and generating the adaptively filtered error signal by summing outputs of the plurality of adaptive notch filters.

33. The method according to claim 27, wherein the step of adaptively filtering the error signal comprises the steps of:

generating a highpass error signal by filtering the error signal with a highpass filter;

generating a lowpass filtered error signal by filtering the error signal with a lowpass filter;

delaying the lowpass filtered error signal;

generating an adaptively filtered lowpass error signal by filtering the delayed lowpass filtered error signal with an adaptive FIR filter;

generating a lowpass error signal by subtracting the adaptively filtered lowpass error signal from the lowpass filtered error signal; and generating the adaptively filtered error signal by summing the lowpass error signal and the highpass error signal.

34. The method according to claim 27, further comprising the steps of:

delaying the electrical output signal of the digital signal processor with a delay unit;

generating a feedback path signal by filtering an output of the delay unit with a frozen filter;

generating an adaptive feedback path signal by filtering the feedback path signal with a second adaptive filter block; and adaptively controlling filter coefficients of the adaptive filter in accordance with the adaptive feedback path signal and the adaptively filtered error signal.

35. The method according to claim 34, further comprising a step of copying filter coefficients of the second adaptive filter block from the filter coefficients of the first adaptive filter block.

36. The method according to claim 27, wherein the step of adaptively controlling filter coefficients of an adaptive filter is accomplished by using an LMS adaptation algorithm.

37. A hearing aid, comprising:

a microphone, said microphone being adapted to receive an input audio signal and an acoustic feedback signal and generate an electrical audio signal;

feedback cancellation means for canceling the acoustic feedback signal, said feedback cancellation means generating a signal processing feedback signal in response to a feedback path signal;

subtracting means, coupled to said microphone and said feedback cancellation means, for subtracting the signal processing feedback signal from the electrical audio signal to form a compensated electrical audio signal;

a signal process unit coupled to said subtracting means, said signal process unit processing the compensated electrical audio signal; and receiver means, coupled to said signal process unit, for converting the processed compensated electrical audio signal into a sound signal, wherein said feedback cancellation means adaptively models an acoustic feedback path, said feedback cancellation means comprising:

a frozen filter block coupled to said signal process unit, said frozen filter block generating the feedback path signal;

first adaptive filter means, coupled to said subtracting means, for adaptively filtering the compensated electrical audio signal to remove low-frequency tonal components of the compensated electrical audio signal;

second adaptive filter means, coupled to said frozen filter block, for adaptively filtering the feedback path signal, said second adaptive filter means being identical to said first adaptive filtering means;

an adaptive filter coupled to said subtracting means, said adaptive filter generating the signal processing feedback signal to said subtracting means; and LMS adaptive means, coupled to said adaptive filter and said first and second adaptive filter means, for controlling adaptive adaptation of filter coefficients of said adaptive filter in accordance with outputs from said first and second adaptive filter means.

38. The hearing aid of claim 37, wherein said frozen filter block includes a feedback delay unit coupled to said signal process unit and a frozen filter coupled to said feedback delay unit, said frozen filter generating the feedback path signal to said second adaptive filter means and said adaptive filter.

39. The hearing aid of claim 37, wherein said first adaptive filter means comprises at least one adaptive notch filter.

40. The hearing aid of claim 39, wherein said at least one adaptive notch filter includes two or more adaptive notch filters connected in series to each other.

41. The hearing aid of claim 39, wherein said first adaptive filter means further comprises a bandpass filter coupled to said subtracting means to filter the compensating electrical audio signal, said bandpass filter being connected in series to said at least one adaptive notch filter.

42. The hearing aid of claim 39, wherein said first adaptive filter means further comprises a highpass filter coupled to said subtracting means to filter the compensating electrical audio signal, said highpass filter being connected in series to said at least one adaptive notch filter.

43. The hearing aid of claim 37, wherein said first adaptive filter means comprises a plurality of adaptive notch filters arranged in parallel combination, said first adaptive filter means further comprising:

a plurality of bandpass filters arranged in parallel combination, each of said plurality of bandpass filters filtering the compensated electrical audio signal and being coupled to one of said plurality of adaptive notch filters; and adder means for summing outputs of said plurality of adaptive notch filters.

44. The hearing aid of claim 37, wherein said first adaptive filter means comprises:

an adaptive FIR filter;

a highpass filter, said highpass filter filtering the compensated electrical audio signal to generate a highpass filtered error signal;

a lowpass filter, said lowpass filter filtering the compensated electrical audio signal to generate a lowpass filtered error signal, a delay unit, said delay unit being coupled between said lowpass filter and said adaptive FIR filter for delaying the lowpass filtered error signal inputted into said adaptive FIR filter;

first subtracting means, coupled to said lowpass filter and said adaptive FIR filter, for subtracting an output of said adaptive FIR filter from the lowpass filtered error signal; and first adder means, coupled to said highpass filter and said first subtracting means, for summing the highpass filtered error signal with an output of said first subtracting means.

45. The hearing aid of claim 37, wherein filter coefficients of said second adaptive filer means are copied from filter coefficients of said first adaptive filter means.

* * * * *